US010837263B2

(12) United States Patent
Lerbrekk et al.

(10) Patent No.: US 10,837,263 B2
(45) Date of Patent: Nov. 17, 2020

(54) INSTALLATION APPARATUS AND METHOD

(71) Applicant: TYRFING INNOVATION AS, Bryne (NO)

(72) Inventors: Morten Lerbrekk, Bryne (NO); Sigurd Goa, Orre (NO); Annette Anfinnsen, Naerbo (NO); Svein Kvernstuen, Sandnes (NO); Alexander Ibragimov, Sola (NO)

(73) Assignee: TYRFING INNOVATION AS, Bryne (NO)

( * ) Notice: Subject to any disclaimer, the term of this patent is extended or adjusted under 35 U.S.C. 154(b) by 195 days.

(21) Appl. No.: 15/773,794

(22) PCT Filed: Oct. 27, 2016

(86) PCT No.: PCT/NO2016/050213
§ 371 (c)(1),
(2) Date: May 4, 2018

(87) PCT Pub. No.: WO2017/078537
PCT Pub. Date: May 11, 2017

(65) Prior Publication Data

US 2018/0320489 A1 Nov. 8, 2018

(30) Foreign Application Priority Data

Nov. 6, 2015 (NO) ..... 20151507

(51) Int. Cl.
*E21B 43/10* (2006.01)
*E21B 7/06* (2006.01)
(Continued)

(52) U.S. Cl.
CPC ..... *E21B 43/103* (2013.01); *E21B 7/061* (2013.01); *E21B 7/18* (2013.01); *E21B 7/20* (2013.01);
(Continued)

(58) Field of Classification Search
CPC ..... E21B 43/305; E21B 7/061; E21B 7/20
See application file for complete search history.

(56) References Cited

U.S. PATENT DOCUMENTS 2,693,342 A * 11/1954 Lynes ..... E21B 43/305 175/78
4,185,705 A * 1/1980 Bullard ..... E21B 4/16 175/78
(Continued)

FOREIGN PATENT DOCUMENTS

CN 104895498 A 9/2015
EP 0791722 A1 8/1997
(Continued)

OTHER PUBLICATIONS

International Search Report and Written Opinion issued in PCT/NO2016/050213 dated Jan. 16, 2017.

*Primary Examiner* — Jennifer H Gay
(74) *Attorney, Agent, or Firm* — Arent Fox LLP

(57) ABSTRACT

An installation apparatus for installing a liner in a subterranean formation includes a housing having an internally arranged flexible member operatively connected to a bore-forming device at one end and to a control module at another end. An opening is arranged in a housing wall through which the flexible member and device may be passed. A liner is arranged around at least a portion of the flexible member between the opening and a first support member. The first support member is arranged to move inside the housing in a direction towards the opening, and a second support member is configured to movably support at least a portion of the flexible member in the region between the control module and the first support member. A method of installing a liner in an inverted drainhole is disclosed.

10 Claims, 6 Drawing Sheets

(51) Int. Cl.

| | |
|---|---|
| ***E21B 7/20*** | (2006.01) |
| ***E21B 43/112*** | (2006.01) |
| ***E21B 17/02*** | (2006.01) |
| ***E21B 43/30*** | (2006.01) |
| ***E21B 7/18*** | (2006.01) |

(52) U.S. Cl.
CPC ..... *E21B 17/02* (2013.01); *E21B 43/10* (2013.01); *E21B 43/112* (2013.01); *E21B 43/305* (2013.01)

(56) References Cited

U.S. PATENT DOCUMENTS

| | | | | |
|---|---|---|---|---|
| 4,640,362 | A * | 2/1987 | Schellstede | E21B 7/061 166/223 |
| 4,646,836 | A * | 3/1987 | Goodhart | E21B 4/02 166/272.1 |
| 5,183,111 | A * | 2/1993 | Schellstede | E21B 7/18 166/212 |
| 5,392,858 | A * | 2/1995 | Peters | E21B 7/061 166/298 |
| 5,622,231 | A | 4/1997 | Thompson | |
| 5,803,666 | A * | 9/1998 | Keller | E21B 7/30 405/146 |
| 5,816,345 | A * | 10/1998 | Keller | B29C 63/36 175/53 |
| 6,109,828 | A * | 8/2000 | Keller | B29C 63/36 175/53 |
| 6,167,968 | B1 * | 1/2001 | Allarie | E21B 4/02 166/298 |
| 6,189,629 | B1 * | 2/2001 | McLeod | E21B 7/061 175/321 |
| 6,244,846 | B1 * | 6/2001 | Keller | B29C 63/36 118/254 |
| 6,283,209 | B1 * | 9/2001 | Keller | E21B 23/00 166/242.2 |
| 6,298,920 | B1 * | 10/2001 | Keller | E21B 19/00 166/377 |
| 6,419,020 | B1 * | 7/2002 | Spingath | E21B 7/061 166/313 |
| 6,910,374 | B2 * | 6/2005 | Keller | E21B 47/10 166/250.02 |
| 7,281,422 | B2 * | 10/2007 | Keller | E21B 47/10 166/250.02 |
| 7,753,120 | B2 * | 7/2010 | Keller | E21B 43/08 166/207 |
| 7,896,578 | B2 * | 3/2011 | Keller | F16L 55/1651 166/264 |
| 7,909,118 | B2 * | 3/2011 | Sanfelice | E21B 7/061 166/117.6 |
| 7,934,563 | B2 * | 5/2011 | Oglesby | E21B 7/061 166/117.5 |
| 7,946,359 | B2 * | 5/2011 | Jeffryes | E21B 43/103 175/325.1 |
| 9,008,971 | B2 * | 4/2015 | Keller | E21B 49/008 702/11 |
| 9,534,477 | B2 * | 1/2017 | Keller | E21B 43/103 |
| 9,797,227 | B2 * | 10/2017 | Keller | E21B 43/103 |
| 10,030,486 | B1 * | 7/2018 | Keller | F04F 1/20 |
| 10,060,252 | B1 * | 8/2018 | Keller | E21B 47/0002 |
| 10,337,314 | B2 * | 7/2019 | Keller | E21B 43/103 |
| 2004/0065438 | A1 * | 4/2004 | Keller | E21B 47/10 166/250.03 |
| 2005/0172710 | A1 * | 8/2005 | Keller | E21B 47/10 73/152.41 |
| 2006/0032672 | A1 * | 2/2006 | Latos | E21B 7/061 175/80 |
| 2009/0003934 | A1 * | 1/2009 | Keller | E21B 49/08 405/150.1 |
| 2009/0211765 | A1 * | 8/2009 | Keller | E21B 43/103 166/377 |
| 2009/0218143 | A1 * | 9/2009 | Sanfelice | E21B 7/061 175/62 |
| 2009/0288884 | A1 | 11/2009 | Jelsma | |
| 2011/0079397 | A1 | 4/2011 | Ayasse | |
| 2012/0173148 | A1 * | 7/2012 | Keller | E21B 47/10 702/11 |
| 2013/0062125 | A1 * | 3/2013 | Savage | E21B 7/061 175/62 |
| 2014/0262346 | A1 * | 9/2014 | Keller | E21B 43/103 166/384 |
| 2014/0262347 | A1 * | 9/2014 | Keller | E21B 43/103 166/384 |
| 2016/0047225 | A1 * | 2/2016 | Keller | E21B 49/08 73/152.28 |
| 2016/0069727 | A1 * | 3/2016 | Keller | G01F 23/14 702/55 |
| 2016/0348482 | A1 * | 12/2016 | Keller | E21B 47/04 |
| 2018/0320489 | A1 * | 11/2018 | Lerbrekk | E21B 43/305 |

FOREIGN PATENT DOCUMENTS

| | | | | |
|---|---|---|---|---|
| EP | 2065554 | A1 * | 6/2009 | E21B 41/0042 |
| WO | WO 2008/157185 | A2 | 12/2008 | |
| WO | WO 2011/041887 | A1 | 4/2011 | |

* cited by examiner

INSTALLATION APPARATUS AND METHOD

CROSS REFERENCE TO RELATED APPLICATIONS

This application is a U.S. National Phase Application of PCT/NO2016/050213 filed Oct. 27, 2016, which claims priority of Norwegian Patent Application No.: 20151507 filed Nov. 6, 2015, both of which are hereby incorporated by reference in their entirety.

FIELD OF THE INVENTION

The invention concerns the field of producing hydrocarbons from a subterranean reservoir. More specifically, the invention concerns an installation apparatus and method for installing a liner in a subterranean formation.

BACKGROUND OF THE INVENTION

Numerous devices and methods for forming deviated well bores in subterranean formations are known.

The prior art includes U.S. Pat. No. 4,646,836, which discloses a method in which an essentially upwardly deviating bore from a vertical shaft is formed in a subsurface earth formation. An outer loop borehole is formed in proximity with the deviated bore. A heating fluid is injected from the surface to the outer loop borehole to heat the formation in proximity with the upward deviated bore to facilitate drainage of oil and the like.

The prior art also includes U.S. Pat. No. 7,934,563, disclosing a method and apparatus for creating inverted laterals or drainholes having an inverted or upwardly inclining bore in a producing interval from a generally vertical wellbore. In the method, a reverse whipstock is lowered, positioned and secured in the wellbore; a tube is secured from the surface to a pull tube which extends above, through and below the reverse whipstock. Fluid is pumped from the surface, through a U-tube below the pull tube and reverse whipstock, to create at least one inverted drainhole. The drilling direction is less than 90° from the vertical and the inverted drainhole drilling direction is initially toward the earth's surface. The wellbore and inverted drainhole form a producing flow path to allow fluids and solids to flow by gravity from the subterranean reservoir into the mostly vertical primary wellbore. Fluids and solids are allowed to flow or be pumped to the earth's surface up the mostly vertical primary wellbore. The reverse whipstock may be secured in the wellbore with an anchor device affixed to a well casing.

The prior art also includes U.S. Pat. No. 6,189,629 B1, which discloses a downhole jet orientation tool, with an upper body and a rotatable lower body. A flexible hose is affixed to a fluid supply line which runs up the well casing to ground level. A flexible perforated liner is carried by the nozzle and hose. The lower portion of the hose channel forms an angled elbow, which directs the hose laterally in the well. The angle of the terminal part of the hose channel as it exits the lower body is preferably at a right angle to the axis of the lower body. A jet blast wear fitting in the lower body surrounds the place where the hose channel exits the lower body approximately at right angles to the central axis of the lower body. This fitting also functions to shear the liner upon rotation of the lower body when the liner is in place in the formation and extending into the lower body. The liner may be sheared by rotation of the lower body, or may be sheared by a cutting device mounted on the tool.

When the channel has been drilled and the jet and hose have been moved back to a station inside the lower body, the liner is held in place by friction from the formation.

The prior art also includes WO 2011/041887 A1, describing a method for forming jet-drilled, lateral boreholes in unconsolidated subterranean formations which are stabilized and remain permanently open by using the forward drive energy of a jet nozzle to drag a perforated liner into the borehole while the borehole is being drilled. The method comprises placing a 90° curved member against the wall of an initial vertical well bore and drilling through the wellbore wall with a drill bit, subsequently removing the bit and inserting the jet nozzle and perforated liner to continue drilling the lateral wellbore.

The prior art also includes WO 2008/157185 A2, which discloses a device for conducting lateral or transverse excavating operations within a wellbore, comprising a rotating drill bit with jet nozzles on a flexible arm. The arm can retract within the housing of the device during deployment within the wellbore, and can be extended from within the housing in order to conduct excavation operations. A fluid pressure source for providing ultra-high pressure to the jet nozzles can be included with the device within the wellbore. The device includes a launch mechanism that supports the arm during the extended position and a positioning gear to aid during the extension and retraction phases of operation of the device.

SUMMARY OF THE INVENTION

The invention is set forth and characterized in the main claim, while the dependent claims describe other characteristics of the invention.

It is thus provided an installation apparatus for installing a liner in a subterranean formation, said apparatus comprising a housing having an internally arranged flexible member operatively connected to a bore-forming device at one end and to a control module in the housing at another end, and an opening in a housing wall through which the flexible member and device may be passed, and wherein the liner arranged around at least a portion of the flexible member between the opening and a first support member; the apparatus being characterized by said first support member being arranged to move inside the housing in a direction towards the opening, and a second support member configured for movably supporting at least a portion of the flexible member in the region between the control module and the first support member.

The first support member and the second support member may be interconnected so as to move as one motive unit.

In one embodiment, at least the second support member is a piston comprising gaskets and arranged for reciprocal movement inside a portion of the housing. A chamber may be arranged between a first surface on the second support member and at least a portion of the housing inner walls. The installation apparatus may comprise casing penetration means.

It is also provided a method of installing a liner in a borehole in a subterranean formation, characterized by the steps of:

a) lowering the invented installation apparatus to a desired location in a main wellbore;

b) releasably setting the installation apparatus in the main wellbore;

c) activating the first support member and the bore-forming device to simultaneously form a borehole and installing a liner in the borehole;

d) retracting the flexible member from the borehole, while leaving the liner in place.

The borehole may be a drainhole, branching off from the main wellbore. The borehole may be a drainhole, upwardly inclined from the main wellbore. In one embodiment of the invented method, an opening is formed in a casing wall after step b) but before step c).

It is also provided an installation apparatus for installing a liner in a subterranean formation, said apparatus comprising a housing having an internally arranged flexible member operatively connected to a bore-forming device at one end and to a control module in the housing at another end, and an opening in a housing wall through which the flexible member and device may be passed, and wherein the liner is arranged around at least a portion of the flexible member between the opening and a first support member; the apparatus being characterized by said first support member being arranged to move inside the an actuation cylinder in a direction towards the opening, and a second support member configured for movably supporting at least a portion of the actuation cylinder.

The invented tool makes it possible to form inverted drainholes in formations, and simultaneously installing a liner, in one downhole trip. The tool, with its unitary housing, contains few moving parts, and is therefore easy to maintain and operate.

BRIEF DESCRIPTION OF THE DRAWINGS

These and other characteristics of the invention will become clear from the following description of a preferential form of embodiment, given as a non-restrictive example, with reference to the attached schematic drawings, wherein.

Figure 1:
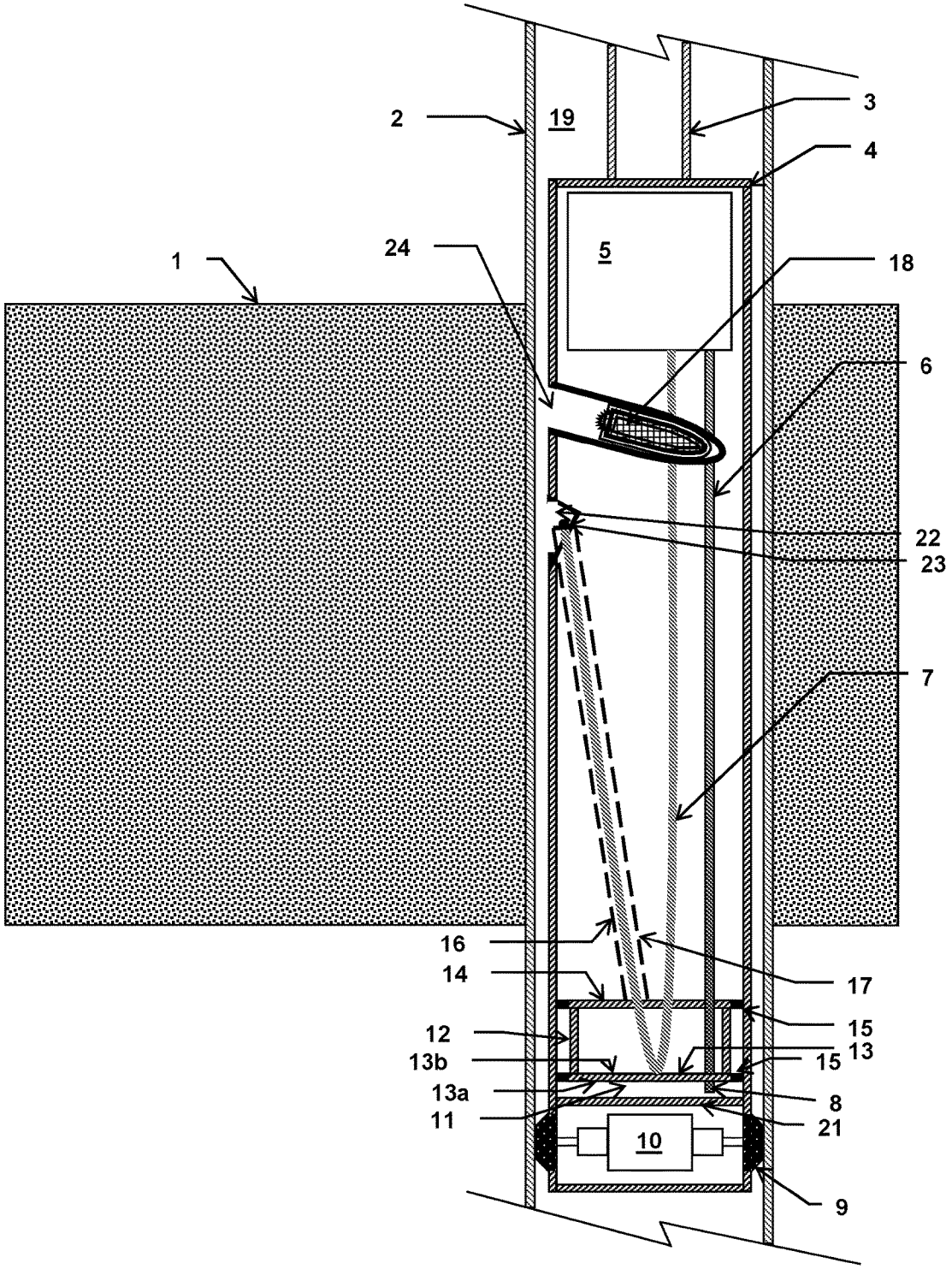
FIG. 1 is a sectional drawing of a first embodiment of the invented tool, set in a well casing in a wellbore in a subterranean formation.

The drawings are not to scale; clearances and the sizes of certain features have been exaggerated in order to illustrate the principles of the invention.

DETAILED DESCRIPTION OF A PREFERENTIAL EMBODIMENT

The following description may use terms such as "horizontal", "vertical", "lateral", "back and forth", "up and down", "upper", "lower", "inner", "outer", "forward", "rear", etc. These terms generally refer to the views and orientations as shown in the drawings and that are associated with a normal use of the invention. The terms are used for the reader's convenience only and shall not be limiting.

The invented installation tool comprises a housing 4, which for example may be a cylinder-shaped body of a steel material. The body is configured and dimensioned for the application at hand. In the embodiment illustrated in FIG. 1, the housing 4 is held in position in the casing 2 by means of anchor dogs 9 that may be actuated between an extended, locking, position (as illustrated) and a retracted, non-activated, position (not shown), by means of actuator unit 10. The casing 2 has been installed in a wellbore 19 in a manner known in the art.

The skilled person will understand that the actuator unit may be powered by any known means in the art, for example hydraulics. Required hydraulic lines, power and control wires are not shown, as these components are known in the art. Although not illustrated, the tool may comprise other anchor dogs, for example arranged in an upper region of the housing.

A control and utility module 5 is arranged inside the housing 4. Although not shown, this module comprises a flow-activated valve, and necessary control means to operate the tool (as will be described below), as per se is well known in the art. Necessary control lines and hydraulic lines extending to the surface above the wellbore are not shown, as these are well known in the art.

Arranged inside a lower portion of the housing 4 is a piston 12, comprising a lower member 13 having an inner surface 13*b* and an outer surface 13*a*. The piston also comprises an upper member 14, arranged a distance above the lower member. The piston 12 is arranged to reciprocate (i.e. move up and down) inside the housing, and comprises gaskets 15 for sealable sliding interaction with the housing inner wall. In the illustrated embodiment, the gaskets 15 are arranged on the upper and lower piston members, but other configurations are conceivable. The piston 12 (in the illustrated embodiment: the lower member 13), a bottom wall 21 inside the housing, and a portion of the housing inner wall, define a chamber 11 inside the housing.

A fluid supply line 6 extends from the control and utility module 5 and into the chamber 11, whereby hydraulic fluids may be supplied into the chamber 11 through the supply line outlet 8. The movement of the piston 12 inside the housing may thus be controlled by the injection or evacuation of pressurized hydraulic fluids into and out of the chamber 11. The supply line is only schematically illustrated in FIG. 1, and it should be understood that the supply line for example may be embedded in the housing wall, so as not to obstruct the movement of the piston.

A flexible hose 7 extends between the control and utility module 5 and a deployment slot 22 in the housing 4 wall. A jet nozzle 23 is fluidly connected to the flexible hose free end, in the vicinity of the deployment slot 22. The flexible hose 7 is fluidly connected to a fluid reservoir (not shown), via the module 5 and the above mentioned hydraulic lines. Such hydraulic jet nozzles and hoses are well known in the art, and need therefore not be described in further detail here.

FIG. 1 shows that, between the module 5 and the deployment slot 22, the flexible hose 7 extends towards the lower part of the housing before curving back up towards the deployment slot, and a lower portion of the flexible hose is in thus contact with the lower member 13. Arranged around an axial portion of the flexible hose 7, between the piston 12 and the deployment slot 22, is a liner 16 with perforations 17. Such liners are known in the art, as mentioned above. The nozzle 23 and an end portion of the liner 16 are releasably connected (e.g. by complementary shoulders, not shown), such that when the nozzle 23 and flexible hose 7 are advanced out of the deployment slot, the liner 16 is carried with the nozzle and hose. The other end portion of the liner 16 is supported by the upper member 14, as shown in FIG. 1.

Figure 2:
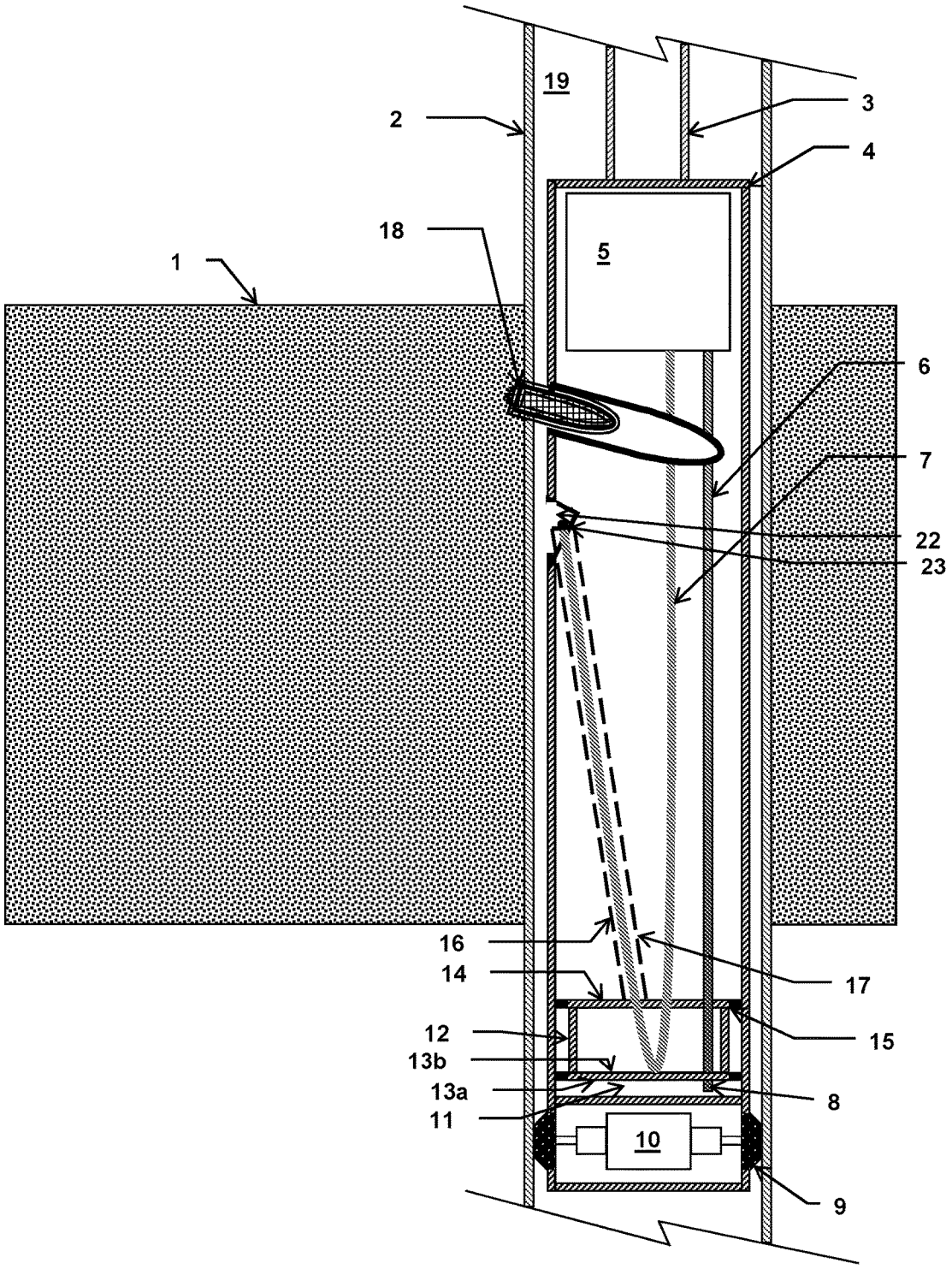
FIG. 2 is a drawing similar to that of in FIG. 1, showing a casing penetration tool in operation.

In the illustrated embodiment, the tool comprises a casing penetrator 18, arranged for reciprocal movement between a retracted position (as shown in FIG. 1) and an extended position (as shown in FIG. 2) through an opening 24 in the housing wall. The casing penetrator 18 may comprise a milling tool, or a blasting device, all of which are well known in the art.

In the illustrated embodiment, both the casing penetrator 18, its associated opening 24, and the hose deployment slot 22 are arranged with an upward inclination, making the tool useful for forming upwardly inclined boreholes, used for formation draining (also referred to as inverted drainholes). The invention shall not, however be limited to such inclinations.

The invented tool is particularly useful for forming lateral bores in unconsolidated subterranean formations, preferably inverted drainholes.

Figure 3:
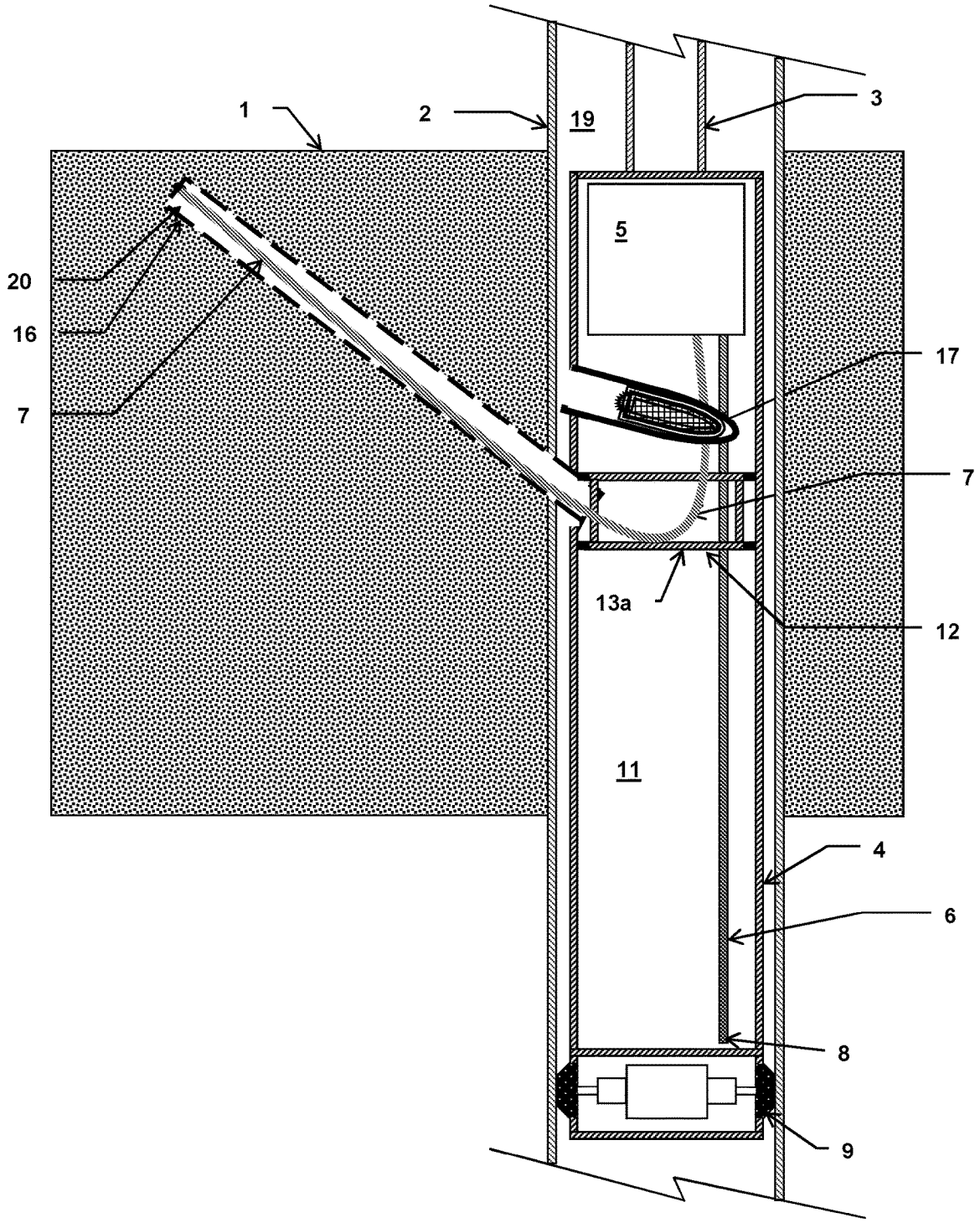
FIG. 3 is a drawing similar to that of in FIG. 1, showing a perforated liner being installed in an upwardly inclined drainhole.

In use, the tool is lowered (e.g. by a drill pipe 3) to a desired location inside a casing 2 in a main wellbore 19 in a formation 1. The tool is positioned in the casing by activation of the anchor dogs 9, as shown in FIG. 1. The casing penetrator 18 is then activated (by means that per se are well known in the art) to form a hole in the casing 2, as shown in FIG. 2. The casing dogs are then retracted (not shown), whereby the tool may be moved (upwards in FIG. 2) until the deployment slot 22 is aligned with the casing hole formed by the casing penetrator. This tool position is illustrated in FIG. 3, which also illustrates the operation of the piston 12. Hydraulic fluids are injected under pressure into the chamber 11 (in the fluid supply line 6, through the outlet 8), whereby the chamber 11 expands and the piston 12 is forced upwards inside the housing. As a portion of the flexible hose 7 is supported by the lower member 13, the flexible hose 7 is pushed upwards by the upward movement of the piston 12, towards the deployment slot 22. Simultaneously, pressurized fluids are fed through the flexible hose 7 and out of the jet nozzle 23, forming a bore in the formation. Although not illustrated, it should be understood that the casing may be penetrated by a variant of the jet nozzle, rendering the casing penetrator optional. If the tool is used in an open-hole (i.e. not cased) wellbore 19, the casing-penetrating operation is not applicable.

FIG. 3 illustrates a state when these operations have been performed: i.e. a bore 20 has been formed in the formation 1 and the perforated liner 16 has been carried into the bore by the nozzle 23. The piston 12 has been moved to the region of the deployment slot. Although not shown, the piston may comprise means for shearing a residual part of the liner extending into the main wellbore, for example by a continued upward piston movement, or by a rotation of the piston.

Figure 4:
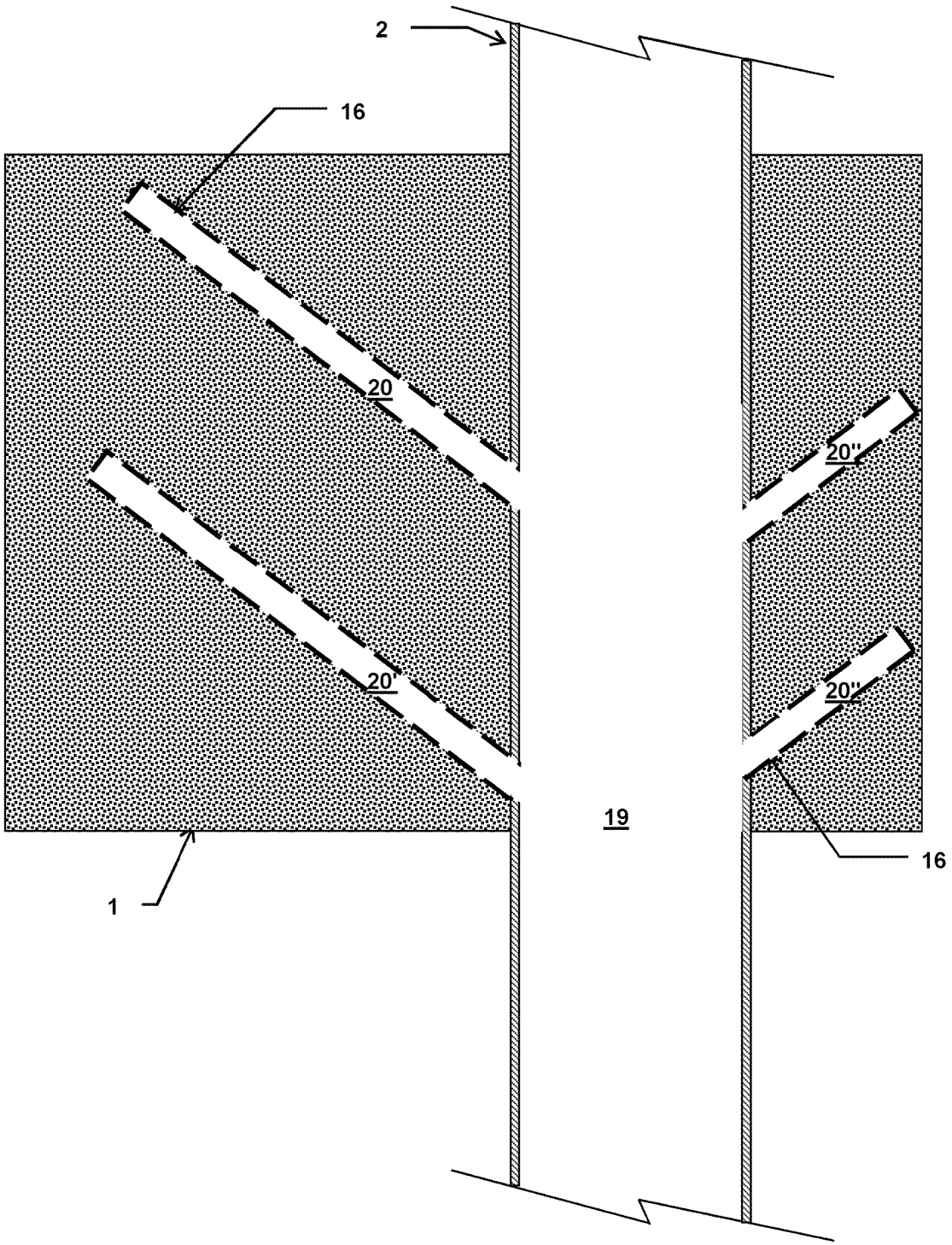
FIG. 4 is a sectional drawing showing a plurality of perforated liners installed in upwardly inclined drainholes.

In FIG. 4, the flexible hose has been withdrawn into the housing, and the tool has been retrieved to the surface, leaving a formed bore (drainhole) 20 with the installed perforated liner 16. A disconnection device (not shown) is normally provided between the flexible hose and the nozzle, such that the nozzle may be abandoned in the bore. FIG. 4 also illustrates that multiple drainholes 20'; 20" may be formed by the invented tool, repositioning the tool axially, and/or by rotating the tool, in the casing.

In use, the tool is conveyed to the desired location in the wellbore by means of for example a drill pipe 3. It should, however, be understood that other conveyance means may be used, for example coiled tubing.

Another embodiment of the invention will now be described with reference to FIGS. 5 and 6.

The invented installation tool comprises also in this embodiment a housing 4, which for example may be a cylinder-shaped body of a steel material. The body is configured and dimensioned for the application at hand. In the embodiment illustrated in FIG. 5, the housing 4 comprises a first (upper) portion 4*a* and a second (lower) portion 4*b*. The two housing portions are movably interconnected, for example by a telescopic connection in the region T, whereby the tool may be extended (i.e. in the axial direction in the casing 2), as illustrated in FIG. 6.

The tool comprises in the illustrated embodiment a single anchor dog 9 that may be actuated between an extended, locking, position (not shown) and a retracted, non-activated, position (as illustrated), by means of actuator unit 10. The skilled person will understand that the actuator unit may be powered by any known means in the art, for example hydraulics. Required hydraulic lines, power and control wires are not shown, as these components are known in the art. Although not illustrated, the tool may comprise other anchor dogs, for example arranged in a lower region of the housing.

A control and utility module 5 is arranged inside the housing 4. Although not shown, this module 5 comprises a flow-activated valve, and necessary control means to operate the tool (as will be described below), as per se is well known in the art. Necessary control lines and hydraulic lines extending to the surface above the wellbore are not shown, as these are well known in the art.

Figure 6:
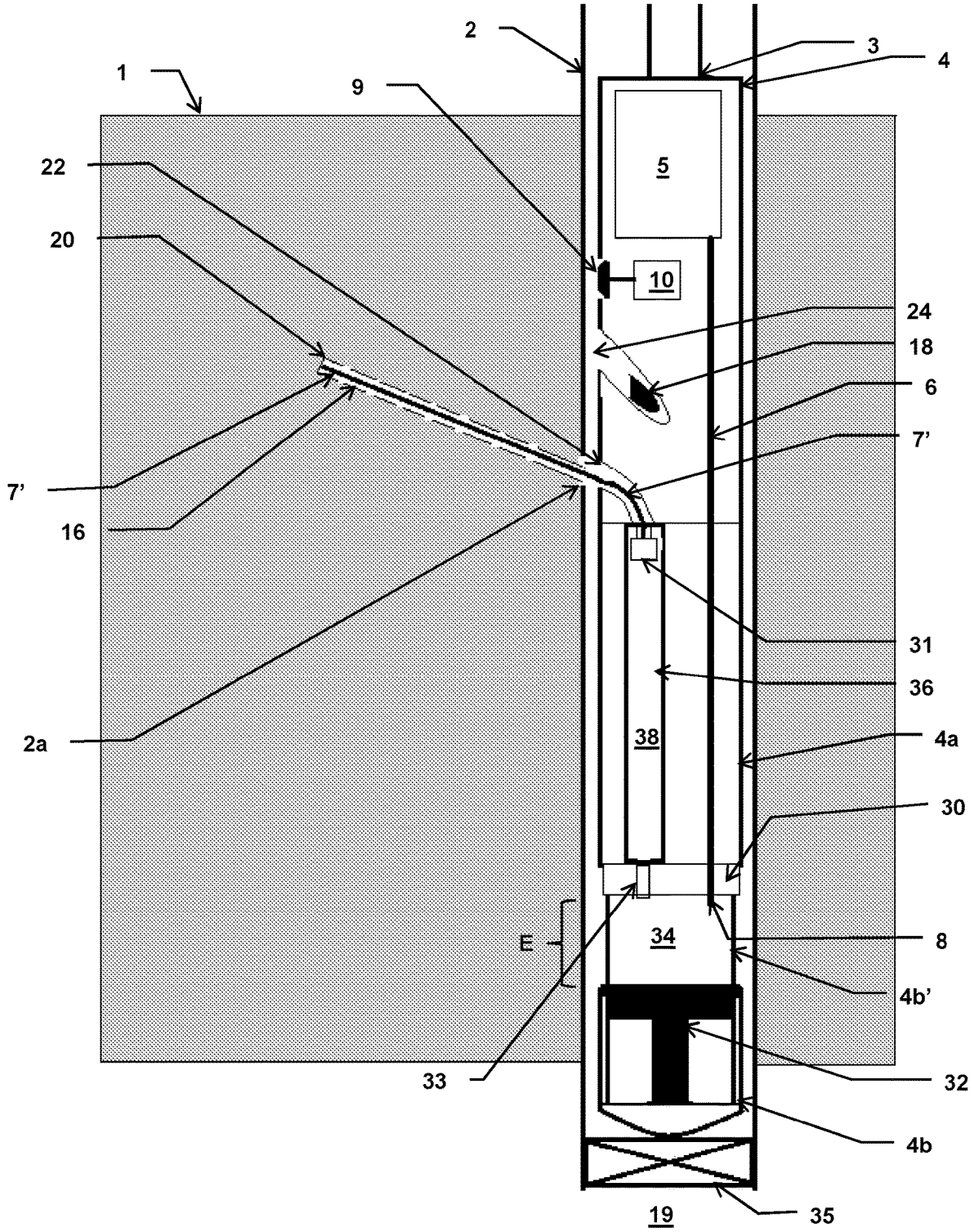
FIG. 6 is a drawing similar to that of in FIG. 5, showing a perforated liner being installed in an upwardly inclined drainhole.

Arranged inside a lower portion of the housing 4 is an advancing member 30 which on its upper side (as shown in the figures) is connected to the upper housing portion 4*a* and on its lower side is sealingly connected to the lower housing portion 4*b* via a wall 4*b*' (best seen in FIG. 6). The advancing member 30, the upper face of a lower foundation 32, and the wall 4*b*' define a chamber 34 inside the housing.

A fluid supply line 6 extends from the control and utility module 5 and into the chamber 34, whereby hydraulic fluids may be supplied into the chamber 34 through a supply line outlet 8. The movement of the advancing member 30 inside the housing may thus be controlled by the injection or evacuation of pressurized hydraulic fluids into and out of the chamber 34. The supply line is only schematically illustrated in FIGS. 5 and 6, and it should be understood that the supply line for example may be embedded in the housing wall, so as not to obstruct the movement of the advancing piston.

Arranged on, and supported by, the advancing member 30 is an actuation cylinder 36, having an open upper end 37. The lower (as seen in FIG. 5) end of the actuation cylinder is closed, except for a fluid connection via a valve 33 between the actuation cylinder 36 interior and the chamber 34. The valve 33 may be a shear valve which is designed to shear (i.e. open) at a predetermined pressure. Thus, when the fluid pressure in the chamber 34 exceeds a predetermined value, the valve 33 will open and allow fluid flow into the actuation cylinder 36. It should be understood that the valve 33 may also be of a type that is controlled by other means.

Inside the actuation cylinder 36 is an installation piston 31, arranged to reciprocate (i.e. move up and down) in the actuation cylinder and comprising gaskets (not shown) for sealable sliding interaction with the actuation cylinder inner wall. Therefore, when the valve 33 allows fluid to flow into the actuation cylinder as described in the preceding paragraph, the installation piston 31 is forced towards the open end 37, forming an expanding chamber 38 inside the actuation cylinder (see FIG. 6).

Figure 5:
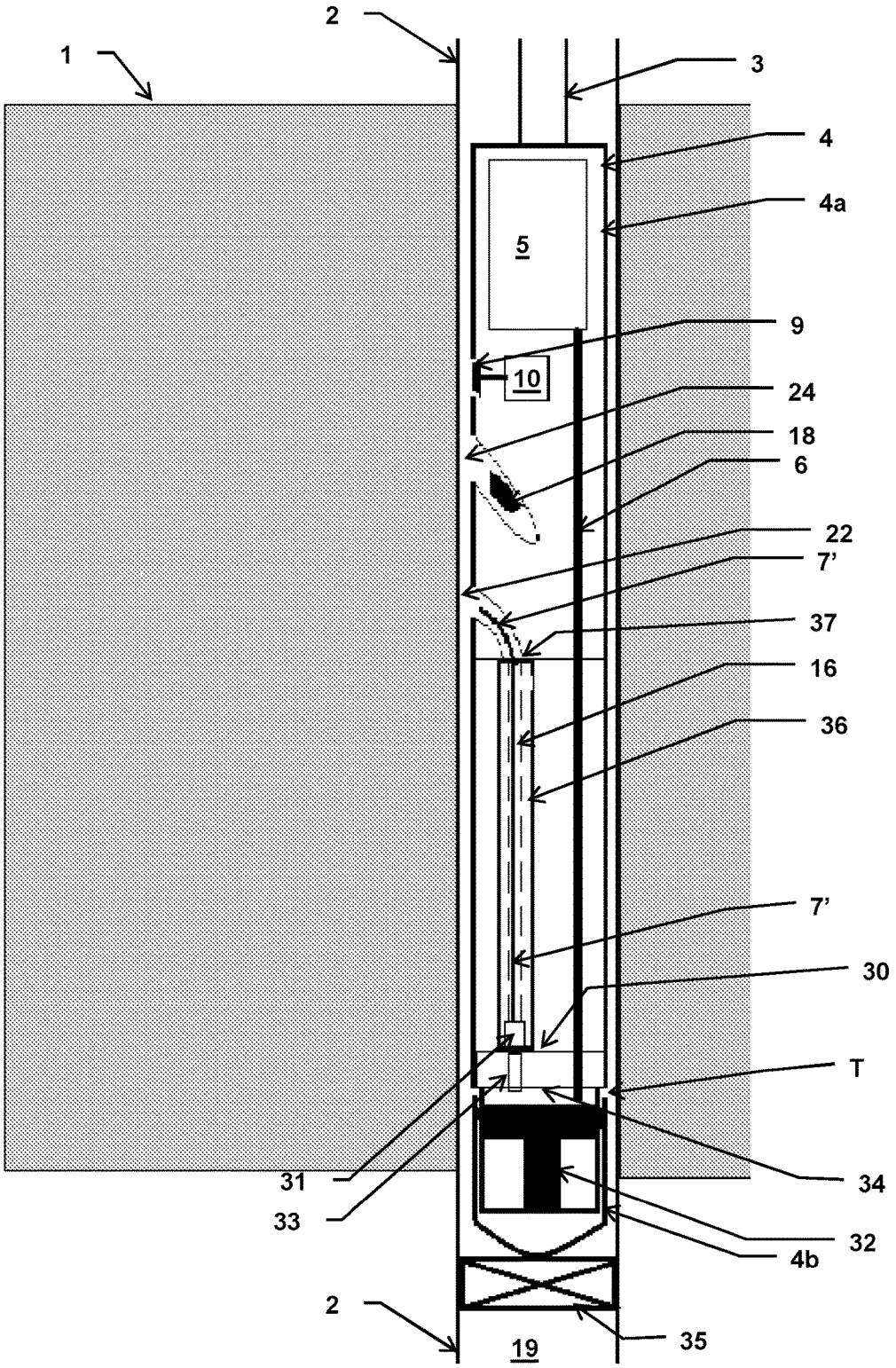
FIG. 5 is a sectional drawing of a second embodiment of the invented tool, run in a well casing in a subterranean formation.

The installation piston 31 supports a flexible hose 7' which extends out of the actuation cylinder 36 and to a deployment slot 22 in the housing 4 wall, as shown in FIG. 5. A jet nozzle 23 (not shown in FIG. 5) is fluidly (and preferably releasably) connected to the flexible hose free end, similarly to in the embodiment described above with reference to FIGS. 1-4.

The flexible hose 7' is fluidly connected to the inner chamber 38 via a fluid channel (not shown) in the installation piston 31. The fluid channel advantageously comprises an orifice or other flow restriction, whereby the fluid flow into the flexible hose 7' may be controlled (either pre-set or remotely).

Arranged around an axial portion of the flexible hose 7', and also supported by the installation piston 31, is a perforated liner 16. Such liners are known in the art, as mentioned above. The nozzle (not shown) at the free end of the flexible hose 7' and an end portion of the liner 16 are releasably connected (e.g. by complementary shoulders, not shown), such that when the nozzle and flexible hose 7' are advanced out of the deployment slot 22, the liner 16 is carried along with the nozzle and hose.

In the illustrated embodiment, the tool comprises a casing penetrator 18, arranged and configured similarly to the casing penetrator described above with reference to FIGS. 1-4. In the embodiment illustrated in FIGS. 5 and 6, both the casing penetrator 18, its associated opening 24, and the hose deployment slot 22 are arranged with an upward inclination, making the tool useful for forming upwardly inclined boreholes, used for formation draining (also referred to as inverted drainholes). The invention shall not, however be limited to such inclinations. The invented tool is particularly useful for forming lateral bores in unconsolidated subterranean formations, preferably inverted drainholes.

In use, the tool is lowered (e.g. by a drill pipe 3) to a desired location inside a casing 2 in a main wellbore 19 in a formation 1. The tool may be positioned in the casing by activation of the anchor dog 9, but FIG. 5 also shows that the tool is supported by a preinstalled plug 35 in the casing. It should be understood that the plug 35 my be substituted or supplemented by other holding means for the lower portion **4*b* of the housing. The hole in the casing 2 is formed by activation of the casing penetrator (by means that per se are well known in the art), as explained above with reference to FIGS. 1-4. However, if the tool is used in an open-hole (i.e. not cased) wellbore 19**, the step of penetrating the casing is not applicable.

When the hole has been formed in the casing (if applicable), the upper housing **4*a* may be moved (upwards in FIGS. 5 and 6) until the deployment slot 22 is aligned with the casing hole 2*a* formed by the casing penetrator (casing hole 2*a* formed by a method similar to the method described above with reference to FIGS. 2-3**). Thus, in operation:

Fluid (e.g. well fluid) is fed under pressure from the control and utility module 5, via the supply line 6 and into the chamber 34, causing the advancing member 31 (and thus the upper housing part **4*a*) to move a distance E upwards until the deployment slot 22 is aligned with the casing hole 2*a*. The wall 4*b'* extends telescopically from the lower housing part 4*b***.

When the fluid pressure in the chamber 34 reaches a predetermined value, the shear valve 33 opens and fluid is entering the actuation cylinder 36 below the installation piston 31, forcing this piston towards the upper end opening 37.

Simultaneously with the fluid-actuated movement of the installation piston 31, an orifice (not shown) allows a portion of the fluid to pass through the installation piston, through the flexible hose 7' and out of the nozzle (not shown) at the free end of the flexible hose, whereby a bore 20 is formed in the formation 1, similarly as described above with reference to FIGS. 2 and 3. Although not illustrated, it should be understood that the casing may be penetrated by a variant of the jet nozzle, rendering the casing penetrator optional.

FIG. 6 illustrates a state when these operations have been performed: i.e. a bore 20 has been formed in the formation 1 and the perforated liner 16 has been carried into the bore by the nozzle. The installation piston 31 has been moved to the upper end opening 37 of the actuation cylinder. Although not shown, the installation piston may comprise means for shearing a residual part of the liner extending into the main wellbore.

Following the operation illustrated by FIG. 6, the nozzle may be disconnected from the flexible hose, and flexible hose may be withdrawn into the housing, and the tool retrieved to the surface, leaving a formed bore (drainhole) 20 with the installed perforated liner 16, similarly to the illustration in FIG. 4. In use, the tool is conveyed to the desired location in the wellbore by means of for example a drill pipe 3. It should, however, be understood that other conveyance means may be used, for example coiled tubing.

Although the invention has been described in the above as having anchor dogs for setting the tool in the casing, it should be understood that the tool may also be used without anchor dogs, when other means are used for positioning the tool in the casing. For example, a separate anchoring device may be locked in position underneath the installation tool.

Although the invention has been described and illustrated as being installed in a cased wellbore, it should be understood that the invented device and method are equally applicable to open-hole (i.e. not cased) wellbores.

The invention claimed is:

1. An installation apparatus for installing a liner in a subterranean formation, comprising;

a housing having a flexible member internally arranged therein and operatively connected to a bore-forming device at one end and to a control module in the housing at another end, and an opening in a housing wall through which the flexible member and bore-forming device is to be passed, and wherein the liner is arranged around at least a portion of the flexible member between the opening and a first support member;

wherein the first support member is arranged to move inside the housing in a direction towards the opening; and a second support member is configured to movably support at least a portion of the flexible member in a region between the control module and the first support member; and wherein the bore-forming device and an end portion of the liner have a connected state when the first support member moves in the direction toward the opening such that the liner is carried with the bore-forming device and the flexible member when the bore-forming device and the flexible member are advanced out of the opening and into a bore created by the bore-forming device, and wherein the bore-forming device and the end portion of the liner have a disconnected state when the bore-forming device and the flexible member are withdrawn into the housing such that the liner remains in the bore.

2. The installation apparatus of claim 1, wherein the first support member and the second support member are interconnected so as to move as one motive unit.

3. The installation apparatus of claim 1, wherein at least the second support member is a piston comprising gaskets and arranged for reciprocal movement inside a portion of the housing.

4. The installation apparatus of claim 3, wherein a chamber is arranged between a first surface on the second support member and at least a portion of the housing inner walls.

5. The installation apparatus of claim 1, further comprising a casing penetration member.

6. A method of installing a liner into a borehole in a subterranean formation, comprising:

lowering the installation apparatus of claim 1 to a desired location in a main wellbore;

releasably setting the installation apparatus in the main wellbore;

activating the first support member and the bore-forming device to simultaneously form a borehole and install the liner in the borehole; and retracting the flexible member from the borehole, while leaving the liner in place.

7. The method of claim 6, wherein the borehole is a drainhole, branching off from the main wellbore.

8. The method of claim 6, wherein the borehole is a drainhole, upwardly inclined from the main wellbore.

9. The method of claim 6, wherein an opening is formed in a casing wall after the releasably setting but before the activating.

10. An installation apparatus for installing a liner in a subterranean formation, comprising;

a housing having a flexible member internally arranged therein and operatively connected to a bore-forming device at one end and a control module in the housing at another end, and an opening in a housing wall through which the flexible member and bore-forming device is to be passed, and wherein the liner is arranged around at least a portion of the flexible member between the opening and a first support member;

wherein the first support member is arranged to move inside of an actuation cylinder in a direction towards the opening; and a second support member is configured to movably support at least a portion of the actuation cylinder; and wherein a free end of the flexible member and end portion of the liner have a connected state when the first support member moves in the direction toward the opening such that the liner is carried with the flexible member when the flexible member is advanced out of the opening and into a bore created by the bore-forming device, and wherein the bore-forming device and the end portion of the liner have a disconnected state when the bore-forming device and the flexible member are withdrawn into the housing such that the liner remains in the bore.

* * * * *